United States Patent [19]

Adler

[11] 4,212,115

[45] Jul. 15, 1980

[54] SEED CORN DRYER APPARATUS

[75] Inventor: Howard Adler, Sharpsville, Ind.

[73] Assignee: Adler's Seeds, Inc., Sharpsville, Ind.

[21] Appl. No.: 957,570

[22] Filed: Nov. 3, 1978

[51] Int. Cl.[2] ..... F26B 25/06

[52] U.S. Cl. ..... 34/215; 34/233

[58] Field of Search ..... 34/210, 215, 232, 233; 98/55; 414/268, 272

[56] References Cited

U.S. PATENT DOCUMENTS

| | | | |
|---|---|---|---|
| 6,550 | 6/1849 | Patten | 34/233 X |
| 522,406 | 7/1894 | Craney | 414/268 |
| 752,688 | 2/1904 | Kramer | 414/272 |
| 769,947 | 9/1904 | Kramer | 414/272 X |
| 2,241,375 | 5/1941 | Campbell | 34/215 X |
| 4,050,164 | 9/1977 | Campbell | 34/233 X |

FOREIGN PATENT DOCUMENTS

| | | | |
|---|---|---|---|
| 1256412 | 2/1961 | France | 34/210 |

*Primary Examiner*—Henry C. Yuen
*Assistant Examiner*—Harold Joyce
*Attorney, Agent, or Firm*—David A. Lundy

[57] ABSTRACT

A seed corn dryer apparatus comprising an exterior shell secured to a foundation. The exterior shell includes a pair of side walls, a front wall, a rear wall, and a roof. A pair of interior walls are secured to the foundation within the exterior shell in a generally parallel and spaced-apart fashion from the side walls. A plenum, divided into upper and lower plenums, is contained between the interior walls. A storage area is contained between the interior walls and side walls. Air can circulate between the upper and lower plenums only through the storage area.

12 Claims, 4 Drawing Figures

SEED CORN DRYER APPARATUS

BACKGROUND OF THE INVENTION

The invention relates to an apparatus for drying grain, and in particular, to a seed corn dryer apparatus.

The efficient operation of seed corn dryers has always been of some concern. This is especially so in light of the constantly increasing demand for grain. Further, the current awareness of the energy shortage has heightened concern with respect to an improved operating efficiency of a seed corn dryer.

An improved operating efficiency has always been a desirable characteristic of a seed corn dryer. The improvement of a seed corn dryer's operational sufficiency can be achieved by an improved plenum structure. The improvement of a seed corn dryer's operational efficiency can also be achieved by improved air circulation through the storage area. The improvement of a seed corn dryer's operational efficiency can be achieved by an improved storage area structure.

Thus, it would be highly desirable to provide a seed corn dryer having an improved operating efficiency.

It would also be highly desirable to provide a seed corn dryer having an improved plenum structure.

Further, it would be highly desirable to provide a seed corn dryer having improved air circulation through the storage area.

Finally, it would be highly desirable to provide a seed corn dryer apparatus having an improved storage area structure.

SUMMARY OF THE INVENTION

Thus, it is an object of the invention to provide an improved seed corn dryer.

It is another object of the invention to provide an improved seed corn dryer having an improved operating efficiency.

It is another object of the invention to provide an improved seed corn dryer having an improved plenum structure.

It is another object of the invention to provide an improved seed corn dryer having improved air circulation through the storage area.

Finally, it is an object of the invention to provide an improved seed corn dryer having an improved storage area structure.

The invention is a seed corn dryer which includes a foundation having an exterior shell, including a pair of opposite upstanding side walls, secured thereto. A pair of interior walls are contained within the exterior shell and are spaced apart from the side walls. A plenum, divided into upper and lower plenums, is contained between the paired interior walls. A grain storage area is contained between corresponding side and interior walls. The invention includes means for circulating air only through the storage area between the upper and lower plenums.

BRIEF DESCRIPTION OF THE DRAWINGS

The above mentioned and other features and objects of this invention and the manner of attaining them will become more apparent and the invention itself will be best understood by reference to the following description of the invention taken in conjunction with the accompanying drawings wherein.

DESCRIPTION OF A SPECIFIC EMBODIMENT

Figure 1:
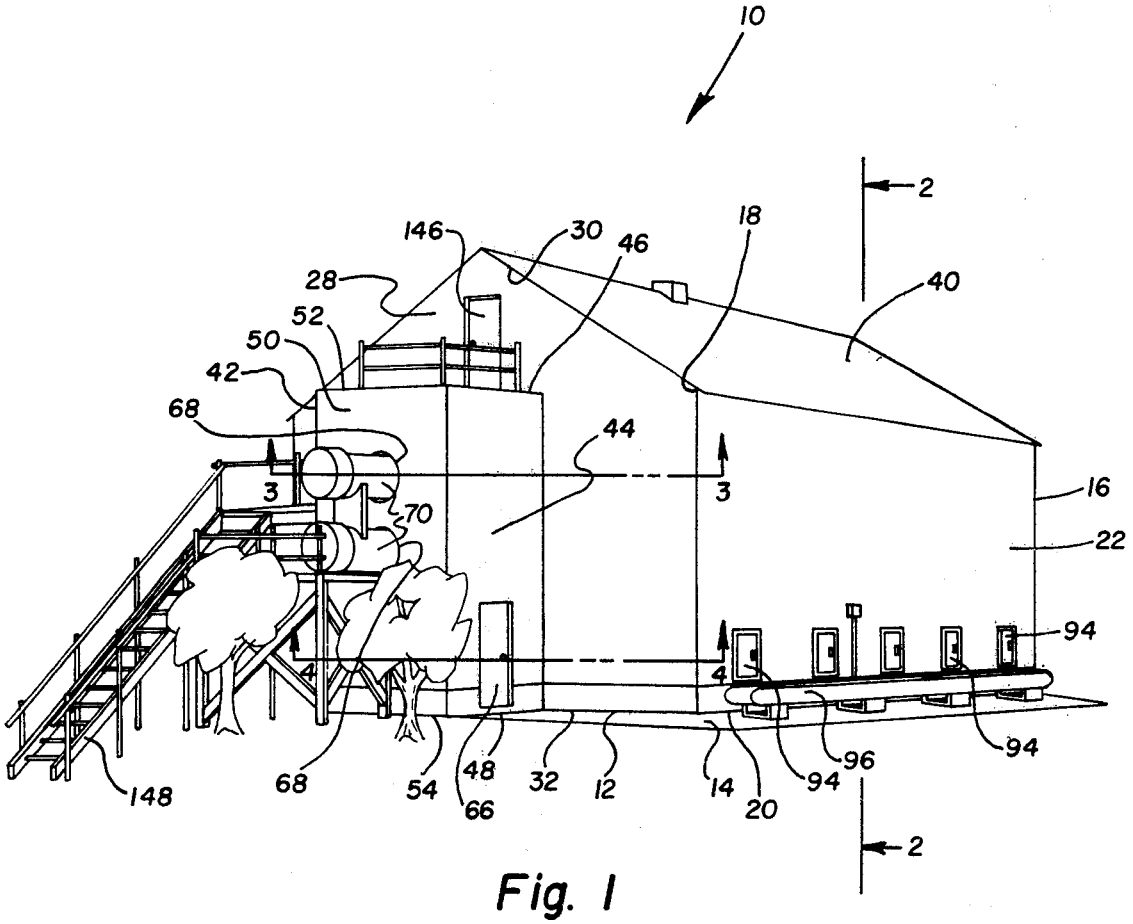
FIG. 1 is a perspective view of the apparatus of the invention.
Figure 2:
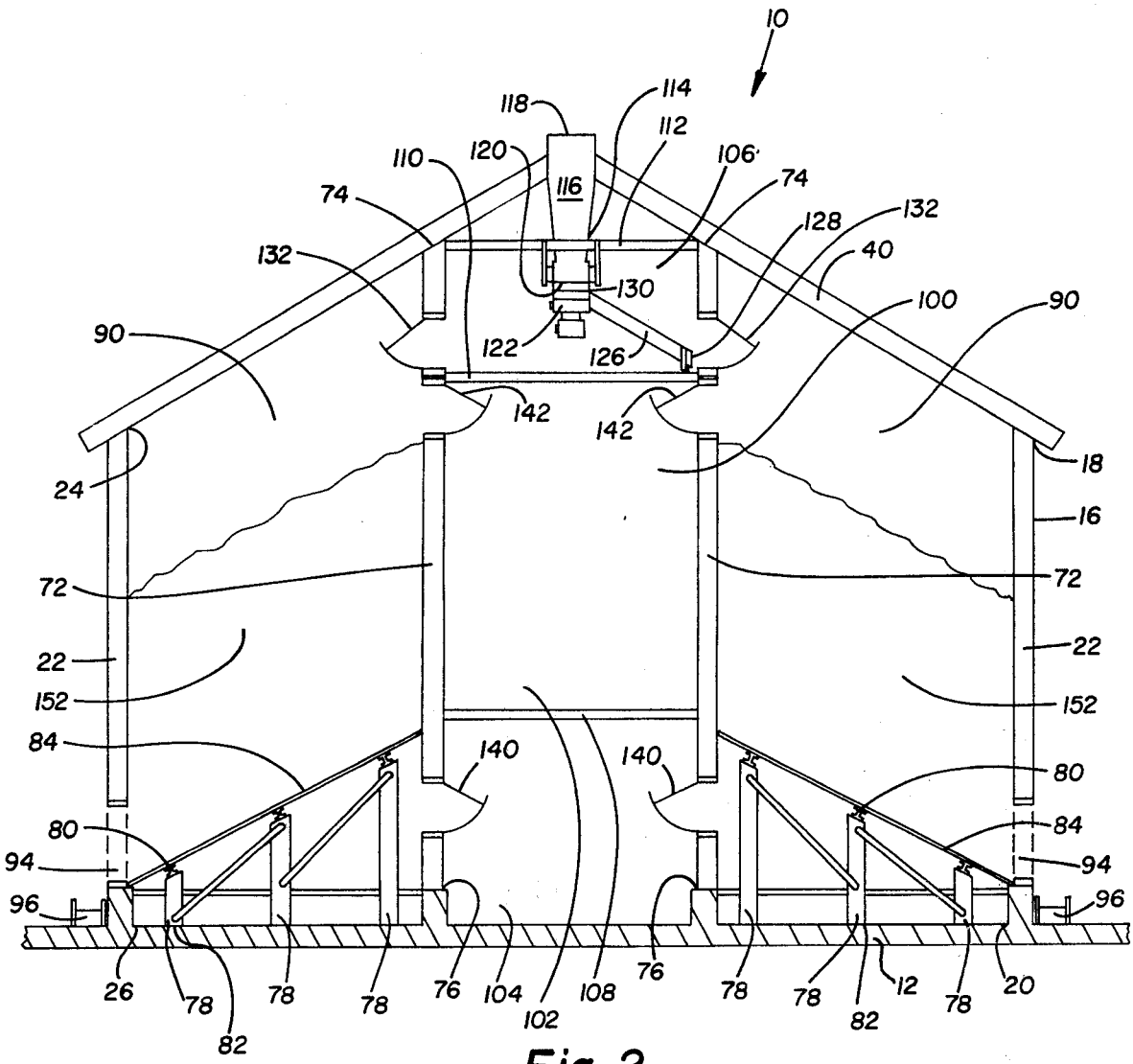
FIG. 2 is a cross-sectional view of the apparatus of the invention taken along section line 2—2 of FIG. 1.
Figure 3:
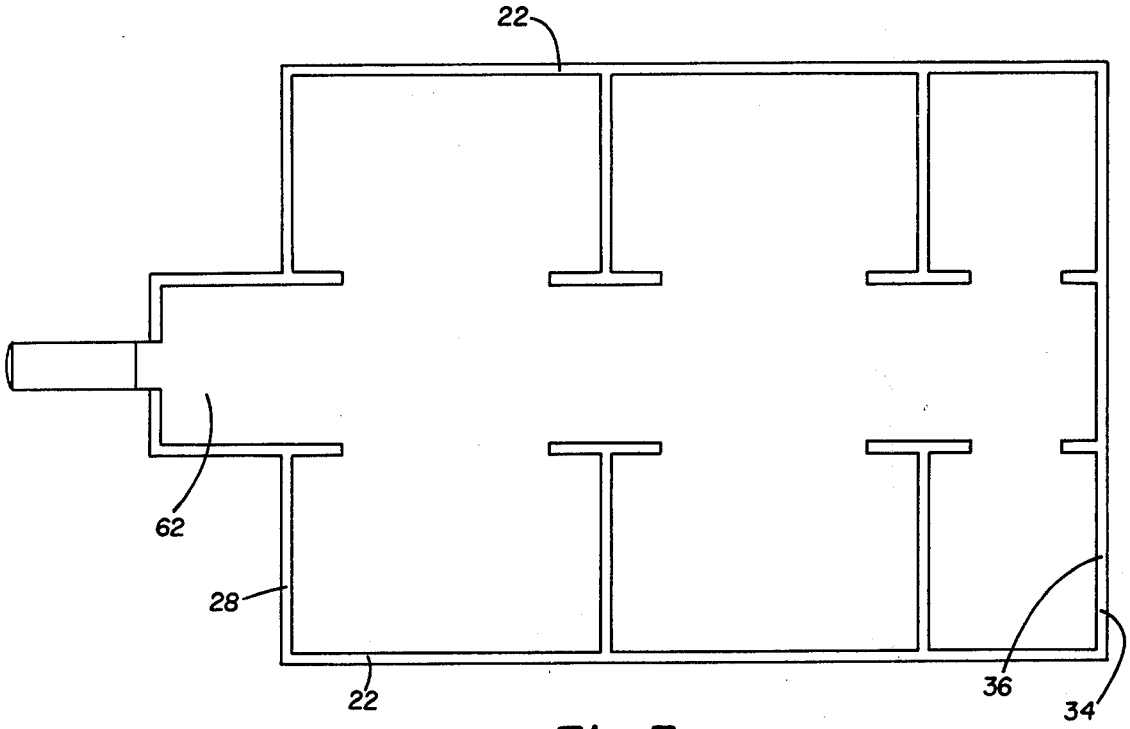
FIG. 3 is a cross-sectional view of the apparatus of the invention taken along section line 3—3 of FIG. 1.
Figure 4:
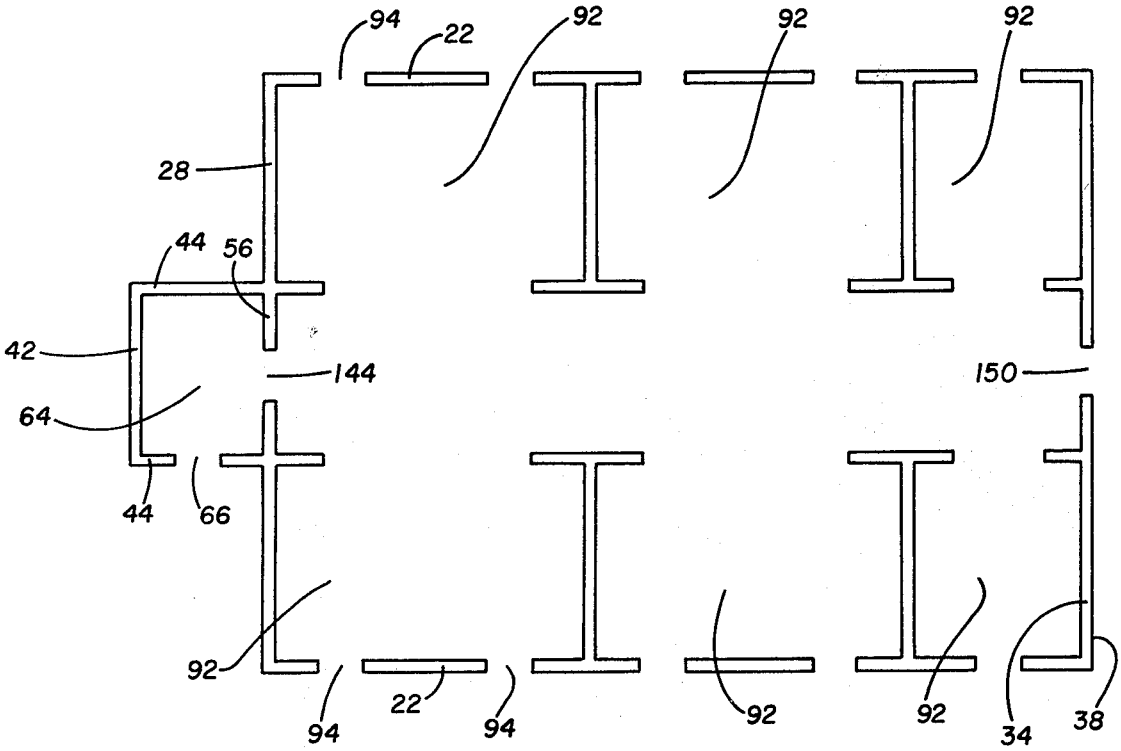
FIG. 4 is a cross-sectional view of the apparatus of the invention taken along section line 4—4 of FIG. 1.

Referring to the drawings, there is illustrated the seed corn dryer apparatus 10 of the invention. The dryer 10 includes a foundation of a conventional cement construction 12 secured to the earth 14. An exterior shell 16, having top 18 and bottom 20 ends, is secured at the bottom end 20 thereof to the foundation 12. The exterior shell 16 includes an opposite pair of side walls 22 having top 24 and bottom 26 ends, a front wall 28 having top 30 and bottom 32 ends, a rear wall 34 having top 36 and bottom 38 ends, and a roof 40. The roof 40 is secured to the side 22, front 28 and rear 34 walls adjacent the top ends 24, 30 and 36 thereof, respectively.

The front wall 28 includes a projection 42 extending forwardly thereform. The projection 42 includes opposite side walls 44 having top 46 and bottom 48 ends, a front wall 50 having top 52 and bottom 54 ends, and an interior rear wall 56. The projection 42 is divided into upper 62 and lower 64 sections. One projection side wall 44 includes a door 66 providing access from the outside into the lower projection section 64. The projection front wall 50 includes a pair of apertures 68 through which pass a pair of blower-heater mechanisms 70. These apertures 68 providing communication between the outside and the upper projection portion 62 via the mechanisms 70.

A pair of vertically upstanding interior walls 72 having top 74 and bottom 76 ends are secured at the bottom ends 76 thereof to the foundation 12 and are contained within the exterior shell 16. These interior walls 72 are spaced apart in a generally parallel fashion with respect to the exterior side walls 22.

A plurality of vertical floor supports 78 having top 80 and bottom 82 ends are secured at the bottom ends 82 thereof to the foundation 12. These floor supports 78 are positioned in a spaced-apart fashion between the interior 72 and exterior side 22 walls. The floor supports 78 become taller as they come closer to the interior walls 72. A pair of perforated floors 84 are secured to the top ends 80 of the vertical floor supports 78, and the perforated floors 84 are downwardly inclined towards their corresponding side walls 22.

A drying area 90 comprises the volume contained within the side walls 22, the interior walls 72, the roof 40 and the perforated floor 84. The storage area 90 is divided into a plurality of compartments 92. A plurality of unloading doors 94 are contained in the exterior side walls 22 adjacent the bottom end 26 thereof. Each compartment 92 has at least one door 94. These unloading doors 94 provide communication between the drying area 90 and the outside. A conveyor 96 is adapted to communicate with compartments 92 through doors 94. The conveyor 96 is designed to transport seed corn to a sheller.

A plenum 100 is contained between the interior walls 72, foundation 12 and roof 40. The plenum 100 is comprised of an upper 102 and lower 104 plenum and a distribution area 106. The upper 102 and lower 104 plenums are divided by a lower partition 108. The upper plenum 102 and the distribution area 106 are divided by an upper partition 110.

The distribution area 106 is located adjacent the roof 40 and includes horizontal support members 112 on which a conveying and distribution assembly or conveyor and track 122 is mounted. A fill hatch 116, having a top 118 and a bottom 120, passes through roof 40. Seed corn to the dryer is fed into hatch 116. By the conveying and distribution apparatus and track 122, seed corn may be delivered into chute 126 and into each of the drying compartments 92 by moving conveyor 122 on track and rollers. Doors 132 contained in the interior walls 72 adjacent the distribution area 106 provide communication between the distribution area 106 and the drying area 90. Seed corn is delivered into drying compartments 92 through doors 132 at a surface repose parallel to perforated floor 84 maintaining uniform seed corn depth and uniform resistance to warm air delivered by mechanisms 70.

A pair of lower plenum doors 140, corresponding to each storage area compartment 92, is contained within the interior walls 72 adjacent the lower plenum 104. The lower plenum doors 140 provide direct communication between the lower plenum 104 and the area underneath the perforated floor 84 where the vertical floor supports 78 are positioned. A pair of upper plenum doors 142, corresponding to each storage area compartment 92, is contained within the upper plenum 102. The upper plenum doors 142 provide direct communication between the upper plenum 102 and the drying area 90.

The upper 102 and lower 104 plenums are not in direct circulation communication, however, they do communicate. Circulation communication between the upper 102 and lower 104 plenums occurs by the air circulating between the upper 142 and lower 140 plenun doors through the drying area 90.

The lower section 64 of the projection 42 includes a door 144 therein which provides access to the lower plenum 104 from the lower projection section 64. The front exterior wall 28 also includes a door 146 contained therein which provides access to the distribution area 110 from the outside. There is a door 147 in the rear exterior wall 34 directly opposite door 146. Stairs 148 are attached to the exterior shell 16 and lead to the doors 146, 147. The rear exterior wall 34 includes a door 150 therein which provides access to the lower plenum 104 from outside.

In operation, the seed corn is delivered through the conveying and distribution assembly 122 and is selectively distributed into either of the storage areas 90 by the moveable conveyor 122 and chute 126. Warm air is blown into the upper plenum 102 via the pair of heaters 70 and circulates out of the upper plenum 102 via the upper plenum doors 142. The warm air then passes downward through the seed corn 152 contained in the storage areas 90 and into the lower plenum 104 via the lower plenum doors 140. The perforations in the perforated floor 84 allow the air to freely pass therethrough.

All plenum doors 140, 142 and 132 are controlled by hand operated winches located in plenum room 104. By a combination of open and closed doors 140, 142 and 132, warm air may be forced through seed corn in any drying storage area compartment 92 from upper plenum 102 through door 142 downward and into plenum 104 via door 140. Air, partly moisture laden, at this point will then travel upward through any drying area compartment 92 whose doors 140 and 132 are open and whose door 142 is closed. Air, moisture saturated at this point will exhaust from the structure via doors 132, 146, 147. By manipulating the doors 140, 142 and 132 warm air may be directed downward or upward through seed corn in any drying compartment 92 at the desire of the operator. Reversing the air direction midway through the drying cycle, which usually requires 3–5 days, attains highly uniform final moisture content of seed corn 152 preparatory to shelling.

The seed corn 152 exits the drying area 90 through the unloading doors 94. The seed corn 152 is then carried away by the conveyor 96 located adjacent the side walls 22.

The plenum 100 structure and the storage area 90 structure force the drying air to circulate between the upper 102 and lower 104 plenums through the storage area 90 where the seed corn 152 is contained. This circulation provides the apparatus 10 of the invention with an improved drying and operating efficiency for seed corn drying operations. Further, the perforated floor 84 provides improved ventilation characteristics for the seed corn.

Thus, it can be seen that the seed corn drying apparatus 10 of the invention provides an overall improved seed corn drying apparatus. The improved plenum 100 forces the air to circulate through the drying corn, either in an upward or downward direction, or a combination of both, as the operator may desire, and consequently, increases the operating efficiency of the apparatus 10. Further, the perforated floor 84 provides for better air circulation through the drying area 90. Finally, the drying area 90 provides for better circulation as well as ease in loading and unloading the dried seed corn.

While there have been described above the principles of this invention in connection with specific apparatus, it is to be clearly understood that this description is made only by way of example and not as a limitation to the scope of the invention.

What is claimed is:

1. A dryer apparatus comprising: a foundation, an exterior shell on said foundation, said exterior shell including a pair of opposite upstanding side walls, a pair of interior walls upstanding from said foundation, said interior walls being spaced-apart from and generally parallel to said side walls, a plenum being located between said paired interior walls, said plenum including upper and lower plenums, a storage area being contained between said side and interior walls, and means for circulating air between the lower and upper plenums only through said storage area, said plenum further includes a grain distribution area positioned above said upper plenum, a closeable passageway being contained in each of said interior walls of said distribution area, said closeable passageways providing selective communication between said distribution area and storage area, and a grain reception-distribution assembly contained in said distribution area.

2. The apparatus of claim 1 wherein said exterior shell further includes front and rear walls, and a roof.

3. The apparatus of claim 2 further including an inclined floor, said floor extending between said interior and side walls, said storage area being defined by said side walls and said front and rear walls and said roof and said interior walls and said floor.

4. The apparatus of claim 3 further including a plurality of upstanding floor supports having top and bottom ends, said bottom ends being supported by said foundation, said floor supports being between said interior and side walls, said floor being supported by said top support ends, said floor supports being of a variety of heights, said floor being downwardly inclined from said interior wall to said side wall.

5. The apparatus of claim 3 wherein said circulating means includes a spaced-apart pair of rows of passageways within said interior walls, one of said rows being within said upper plenum and another of said rows being within said lower plenum, and a plurality of perforations within said floor.

6. The apparatus of claim 5 wherein said circulating means further includes a plurality of perforations in said floor, said perforations provide for communication between said plenum and said storage area, said rows of interior row passageways provide for communication between said upper and lower plenums and said storage area.

7. The apparatus of claim 3 wherein said grain reception-distribution assembly includes a distribution chute, said distribution chute being generally parallel to said inclined floor.

8. The apparatus of claim 1 wherein said storage area includes a plurality of compartments.

9. The apparatus of claim 1 wherein said side walls include a plurality of unloading doors, a conveyor assembly adjacent to at least one of said side walls, said unloading doors placing said storage area and conveyor assembly in communication.

10. The apparatus of claim 1 further including a heater assembly, said heater assembly providing heat to the air circulating within said exterior shell.

11. The apparatus of claim 1 wherein said closeable passageways each include a door, said door closes inward towards said distribution area.

12. A dryer apparatus comprising: a foundation, an exterior shell on said foundation, said exterior shell including a pair of opposite upstanding side walls, a pair of interior walls upstanding from said foundation, said interior walls being spaced-apart from and generally parallel to said side walls, a plenum being located between said paired interior walls, said plenum including upper and lower plenums, a storage area being contained between said side and interior walls, and means for circulating air between the lower and upper plenums only through said storage area, said plenum further includes a grain distribution area positioned above said upper plenum, a closeable passageway being contained in each of said interior walls of said distribution area, said closeable passageways providing selective communication between said distribution area and storage area, and means, located in said distribution area, for receiving and distributing grain so as to maintain a uniform depth of grain in the storage area.

* * * * *